US005794272A

United States Patent [19]

Workman et al.

[11] Patent Number: 5,794,272

[45] Date of Patent: Aug. 18, 1998

[54] PROTECTIVE HELMET WITH IMPROVED RETENTION SYSTEM HAVING A REAR STABILIZER

[75] Inventors: Kurt Workman, Santa Cruz; Steven Sasaki, Campbell; John O'Neel, Menlo Park; John Kari, San Jose, all of Calif.

[73] Assignee: Specialized Bicycle Components, Inc., Morgan Hill, Calif.

[21] Appl. No.: 594,461

[22] Filed: Jan. 31, 1996

Related U.S. Application Data

[60] Provisional application No. 60/001,168 Jul. 14, 1995.

[51] Int. Cl.[6] ..... A42B 3/08

[52] U.S. Cl. ..... 2/421; 2/425

[58] Field of Search ..... 2/410, 411, 415, 2/417, 418, 421, 425

[56] References Cited

U.S. PATENT DOCUMENTS

| | | | |
|---|---|---|---|
| D. 316,164 | 4/1991 | Fürthbauer et al. | D29/12 |
| 631,880 | 8/1899 | Ross . | |
| 1,537,178 | 5/1925 | Maynard . | |
| 2,081,335 | 5/1937 | Levinson | 2/3 |
| 2,739,310 | 3/1956 | Frieder et al. | 2/3 |
| 2,763,863 | 9/1956 | Bowers, Sr. | 2/3 |
| 2,769,176 | 11/1956 | Grancsay et al. | 2/3 |
| 2,814,043 | 11/1957 | Alesi | 2/3 |

(List continued on next page.)

FOREIGN PATENT DOCUMENTS

| | | |
|---|---|---|
| 1329863 | 5/1994 | Canada . |
| WO89/01744 | 3/1989 | WIPO . |
| WO95/01739 | 1/1995 | WIPO . |

OTHER PUBLICATIONS

*American Bicyclist & Motorcyclist*, Mar. 1985, pp. 34, 46, 47, 49 and 51–57.

*Bicycling*, Mar. 1990, p. 57, depicting the "Trek USA" helmet.

Product Brochure by Echelon Sports Corporation (1989), depicting the "Look" helmet.

Product Brochure by Innova–Dex Sports, Inc. (1989), depicting the "Gara" cycling helmet.

Photocopies of photographs of Giro Prolight™ helmet, (3 pages total).

Product Brochure by Aria Sonics (1989), depicting the "Tempest" helmet.

*Bicycling*, Jun. 1991, p. 63, depicting the "Air Force™ II" helmet by Specialized Bicycle Components.

Product Brochure by Innova–Dex Sports, Inc. (1989), depicting the "Avanti" helmet.

*Bicycling*, Oct. 1991, p. 81, depicting the "Louis Garneau" helmet.

*Bicycling*, Feb. 1992, p. 25, depicting the "Louis Garneau" helmet.

*Bicycling*, Feb. 1992, p. 29, depicting the "Hammerhead SC™" helmet by Giro.

*Bicycling*, Jul. 1988, p. 89, depicting "Vetta Helmets".

*Bicycling*, Jul. 1988, p. 119, depicting "Giant AT–750 Helmets".

Product advertisement by WSI California (1995), depicting the "Avenir" helmet featuring Duo–Loc™ Stabilizer.

*Colorado Cyclist*, Fall 1995, pp. 22–24, depicting the "Bell", Giro and Troxel helmets.

*Primary Examiner*—Michael A. Neas

*Attorney, Agent, or Firm*—Burns, Doane, Swecker & Mathis, L.L.P.

[57] ABSTRACT

The invention relates to a protective bicycling helmet with a retention system having a rear support member for providing a more comfortable and secure fit on a user's head for greater protection and safety. One embodiment of the helmet has a rear stabilizer mounted at its first end to the rear portion of a helmet body. The other elements of the helmet retention system engage the front portion of the helmet body and engage the second end of the rear stabilizer. The rear stabilizer is shaped to conform to the back of the user's head and extends down from the helmet body such that the helmet retention system engages the nape of the neck of the user.

22 Claims, 16 Drawing Sheets

U.S. PATENT DOCUMENTS

| | | | |
|---|---|---|---|
| 3,015,104 | 1/1962 | Crosson et al. | 2/6 |
| 3,041,621 | 7/1962 | Brockway | 2/3 |
| 3,105,240 | 10/1963 | Jansson | 2/3 |
| 3,107,356 | 10/1963 | Pestronk et al. | 2/3 |
| 3,155,981 | 11/1964 | McKissick et al. | 2/3 |
| 3,214,809 | 11/1965 | Edwards | 24/68 |
| 3,230,544 | 1/1966 | Mager | 2/3 |
| 3,354,468 | 11/1967 | Bowers, Jr. | 2/3 |
| 3,387,304 | 6/1968 | Simpson et al. | 2/3 |
| 3,388,405 | 6/1968 | Simpson et al. | 2/3 |
| 3,591,863 | 7/1971 | Rickard | 2/3 |
| 3,628,190 | 12/1971 | Molitoris | 2/3 A |
| 3,629,864 | 12/1971 | Latina | 2/3 A |
| 3,714,668 | 2/1973 | Mirabella | 2/3 C |
| 3,720,955 | 3/1973 | Rawlings | 2/3 R |
| 3,758,889 | 9/1973 | Erb | 2/3 B |
| 3,783,450 | 1/1974 | O'Connor | 2/3 R |
| 3,787,894 | 1/1974 | Goodman, Jr. | 2/3 A |
| 3,852,821 | 12/1974 | Mickel | 2/3 R |
| 3,950,788 | 4/1976 | Lamb | 2/3 R |
| 3,991,423 | 11/1976 | Jones | 2/415 |
| 4,000,520 | 1/1977 | Svendsen et al. | 2/418 |
| 4,044,400 | 8/1977 | Lewicki et al. | 2/421 |
| 4,051,555 | 10/1977 | Daly | 2/412 |
| 4,055,860 | 11/1977 | King | 2/416 |
| 4,075,714 | 2/1978 | Ryder et al. | 2/6 |
| 4,075,715 | 2/1978 | Cowgill | 2/6 |
| 4,115,874 | 9/1978 | Hasegawa | 2/425 |
| 4,117,554 | 10/1978 | Palumbo | 2/418 |
| 4,263,679 | 4/1981 | Erlendson | 2/421 |
| 4,279,038 | 7/1981 | Brückner et al. | 2/425 |
| 4,293,960 | 10/1981 | Palmaer | 2/416 |
| 4,404,690 | 9/1983 | Farquharson | 2/420 |
| 4,434,514 | 3/1984 | Sundahl et al. | 2/425 |
| 4,443,891 | 4/1984 | Blomgren et al. | 2/414 |
| 4,461,044 | 7/1984 | Reiterman et al. | 2/421 |
| 4,463,456 | 8/1984 | Hanson | 2/416 |
| 4,477,929 | 10/1984 | Mattsson | 2/425 |
| 4,519,099 | 5/1985 | Kamiya et al. | 2/424 |
| 4,555,816 | 12/1985 | Broersma | 2/425 |
| 4,599,752 | 7/1986 | Mitchell | 2/425 |
| 4,641,382 | 2/1987 | Gessalin | 2/421 |
| 4,700,411 | 10/1987 | Kawasaki et al. | 2/425 |
| 4,741,054 | 5/1988 | Mattes | 2/421 |
| 4,796,309 | 1/1989 | Nava | 2/414 |
| 4,833,735 | 5/1989 | Long et al. | 2/419 |
| 4,856,119 | 8/1989 | Häberle | 2/417 |
| 4,884,301 | 12/1989 | Aileo | 2/421 |
| 4,888,831 | 12/1989 | Oleson | 2/420 |
| 4,903,350 | 2/1990 | Gentes et al. | 2/421 |
| 4,912,777 | 4/1990 | Gasbarro | 2/2.1 R |
| 4,999,846 | 3/1991 | Ball et al. | 2/5 |
| 5,042,093 | 8/1991 | Legendre | 2/419 |
| 5,044,019 | 9/1991 | Shewchenko et al. | 2/421 |
| 5,079,780 | 1/1992 | Coombs et al. | 2/420 |
| 5,083,320 | 1/1992 | Halstead | 2/413 |
| 5,083,321 | 1/1992 | Davidsson | 2/421 |
| 5,093,936 | 3/1992 | Copeland et al. | 2/419 |
| 5,099,523 | 3/1992 | Broersma | 2/411 |
| 5,113,534 | 5/1992 | Lane et al. | 2/416 |
| 5,119,516 | 6/1992 | Broersma | 2/411 |
| 5,121,508 | 6/1992 | Grilliot et al. | 2/421 |
| 5,123,121 | 6/1992 | Broersma | 2/421 |
| 5,129,108 | 7/1992 | Copeland et al. | 2/424 |
| 5,142,705 | 9/1992 | Edwards | 2/418 |
| 5,150,479 | 9/1992 | Oleson | 2/414 |
| 5,179,735 | 1/1993 | Thomanek | 2/6 |
| 5,237,707 | 8/1993 | Lowrie | 2/416 |
| 5,337,420 | 8/1994 | Haysom et al. | 2/410 |
| 5,381,560 | 1/1995 | Halstead | 2/421 |
| 5,448,780 | 9/1995 | Gath | 2/424 |
| 5,551,094 | 9/1996 | Navone | 2/421 |
| 5,581,819 | 12/1996 | Garneau | 2/421 |
| 5,638,551 | 6/1997 | Lallemand | 2/421 |

PROTECTIVE HELMET WITH IMPROVED RETENTION SYSTEM HAVING A REAR STABILIZER

This application claims the benefit of U.S. Provisional Application No. 60/001,168, filed Jul. 14, 1995.

FIELD OF THE INVENTION

The present invention relates to a cycling helmet, and more particularly to a protective cycling helmet with a retention system having a rear stabilizer for providing a more comfortable, safe and secure fit on a user's head for greater protection and stability.

BACKGROUND OF THE INVENTION

Protective helmets of many varieties exist to provide head protection for military, construction and recreational activities. These helmets often have a fit system for ensuring that the helmet is fitted and positioned comfortably on the user's head. They also often incorporate a chin strap or other such retention system for ensuring that the helmet remains on the user's head in the event of an impact.

U.S. Pat. No. 2,763,863 issued to Bowers illustrates a protective helmet with a fit system only. The suspension cradle system of the type illustrated in Bowers allows the helmet to be worn comfortably for extended periods of time and generally provides protection when there is limited movement of the user's head and generally only from objects falling onto the top of the helmet.

U.S. Pat. No. 5,023,958 issued to Rotzin shows a helmet with essentially only a retention system. The retention system consists of a chin strap that passes through one side of the helmet across the top of the helmet and back through the helmet to join under the chin. The chin strap is snugged under the chin to retain the helmet firmly on the user's head. This type of retention system retains the helmet on the user's head in the event of a crash in which there is a great deal of movement of the user's head and in which the impact may not be directly down on the top of the user's head.

Protective bicycling helmets have conventionally been constructed with an energy absorbing rigid expanded foam liner and a shell or covering formed of thin plastic or fabric. These conventional helmets are manufactured in varying sizes and have the conventional retention system with adjustable chin straps to fit cyclists with different sized heads. However, fit and retention achieved with the conventional retention system of the one piece helmet is not always adequate. Particularly for mountain bikers who travel on rough roads, the conventional one piece helmet tends to rattle around on the cyclist's head creating an unwanted distraction and annoyance. Also, in the event of a fall or other accident, an improperly fitted and retained helmet may hinder the ability of the helmet to provide its intended protection function.

In an attempt to address the problem of fit, it has been proposed to provide a fit system and a conventional retention system in the helmet. Examples of helmets having a retention system and a separate fit system are shown in International Patent Application PCT/US94/07643 having Publication No. 95/01739 and published on Jan. 19, 1995, and in U.S. Pat. No. 5,381,560 issued to Halstead on Jan. 17, 1995. Other examples of helmets having a retention system and a separate fit system include U.S. Pat. Nos. 2,769,176, 2,814,043, 3,714,668, 3,852,821 and 5,113,534. The fit system disclosed in International Patent Application PCT/US94/07643 to be used with a conventional retention system is a flexible plastic member at the rear of the helmet with elastic straps extending upward and forward from the plastic member. The flexible plastic member can be tightened against the back of the cyclist's head by the elastic straps connected to the bottom of the plastic member and attached by VELCRO® to the inside of the helmet. This helmet uses a conventional retention system and utilizes the flexible plastic member as part of a fit system to provide for a more comfortable and stable fit. Although this helmet is designed to impart some amount of tightening ability to the helmet to provide a comfortable fit, it has some drawbacks. First, the flexible plastic member attached to the helmet is not part of the retention system of the helmet therefore it provides little or no additional support in holding the helmet in place in the event of an impact. Second, there is not enough rigidity in the flexible plastic member to prevent a user from wearing the helmet incorrectly positioned on the head (e.g., rotated too far back). Third, because the flexible plastic member is not part of the retention system, it does not get the straps of the system positioned at the nape and/or spread laterally across the nape for a more secure and safe fit.

SUMMARY OF THE INVENTION

The adjustable protective helmet according to the preferred embodiments of the present invention addresses these problems by providing a rear stabilizer (i.e., support member) that is part of the retention system of the helmet. In other words, instead of using a separate retention system and a separate fit system as does the prior art, the fit system is integrated into the retention system to provide an improved retention system while providing better fit. The rear stabilizer of the present invention is sufficiently rigid to prevent a user from placing and/or tilting the helmet too far back on the user's head. The rigidity of the rear stabilizer helps to ensure that the user places the helmet square on their head. The proper position of the helmet is to have the forward edge of the helmet just above the eye brows of the user such that the user is provided with good protection but can still see forward safely. The rear stabilizer is biased (i.e., tending toward one direction) and/or orientated toward the front of the helmet such that rear stabilizer at least partially cradles or conforms to the back of the user's head and/or neck without the user having to snug the retention straps. The rear stabilizer is resilient (i.e., elastic) and deflectable (i.e., semi-flexible, pliant, bendable, and/or deformable) such that the user can snug the rear stabilizer to the back of the user's head and/or neck by tightening the retention straps. In addition, the rear stabilizer positions the straps of the retention system below the occipital protuberance particularly, spreading the retention system laterally across the nape for greater retaining ability in the event of a crash and greater comfort for periods of long use.

In one embodiment of the present invention, there is provided an adjustable protective helmet for a cyclist comprising a helmet body having a front portion and a rear portion; a rear stabilizer having one portion mounted in the rear portion of the helmet body, said rear stabilizer shaped to conform to the back of the cyclist's head or neck; a helmet retention system for retaining the helmet body and the rear stabilizer in a desired position on the cyclist's head, said helmet retention system being engaged with the helmet body on oppositely disposed sides of the helmet body and being engaged with the rear stabilizer; said rear stabilizer extending from the rear portion of the helmet body such that at least a portion of the helmet retention system contacts the cyclist below the occipital protuberance when the helmet body is located at the desired position on the cyclist's head.

In another embodiment of the present invention, there is provided a helmet for being worn on an individual's head to protect the individual's head comprising a helmet body having a front portion and a rear portion; a resilient and deflectable rear stabilizer having one portion mounted in the rear portion of the helmet body and being oriented toward the back of the individual's head and neck, said rear support member being curved to accommodate the back of the individual's head and neck; and an adjustable helmet retention system for securing the helmet to the individual's head, said helmet retention system being engaged with the front portion of the helmet body on each side of the individual's head and engaged with the rear stabilizer; the rear stabilizer deflecting toward the front portion of the helmet body as the individual adjusts the helmet retention system.

In accordance with another embodiment of the present invention, there is provided a support member for improving a retention system of a cyclist's helmet having a retention system comprising a retaining clip and an inverted Y-shaped mounting arm for attaching at a first end to a rear portion of the cyclist's helmet and at least two angled arms extending generally laterally from a second end opposite the first end of the mounting arm for receiving the helmet retention system through openings in said retention strap arms, said support member being semi-flexible and curved to accommodate the back of the cyclist's head and neck, said mounting arm being attached to the rear portion of the cyclist's helmet by engaging said retaining clip.

Other aspects of the invention include a helmet wherein the rear stabilizer comprises a rear support member defined by a base and two laterally extending arms, the base being attached through the rear portion of the helmet body and the helmet retention system being engaged with the laterally extending arms. Another aspect includes a helmet wherein the rear stabilizer comprises a generally Y-shaped rear support member defined by a base and two angled arms, the base being attached through the rear portion of the helmet body and the helmet retention system being engaged with the angled arms. Yet another aspect includes a helmet wherein the rear stabilizer is resilient and deflectable and the arms of the rear stabilizer are at least as deflectable as the base.

BRIEF DESCRIPTION OF THE DRAWING FIGURES

The invention will be described in greater detail with reference to the accompanying drawings, in which like elements bear like reference numerals, wherein.

DETAILED DESCRIPTION OF THE PREFERRED EMBODIMENTS

Figure 1A:
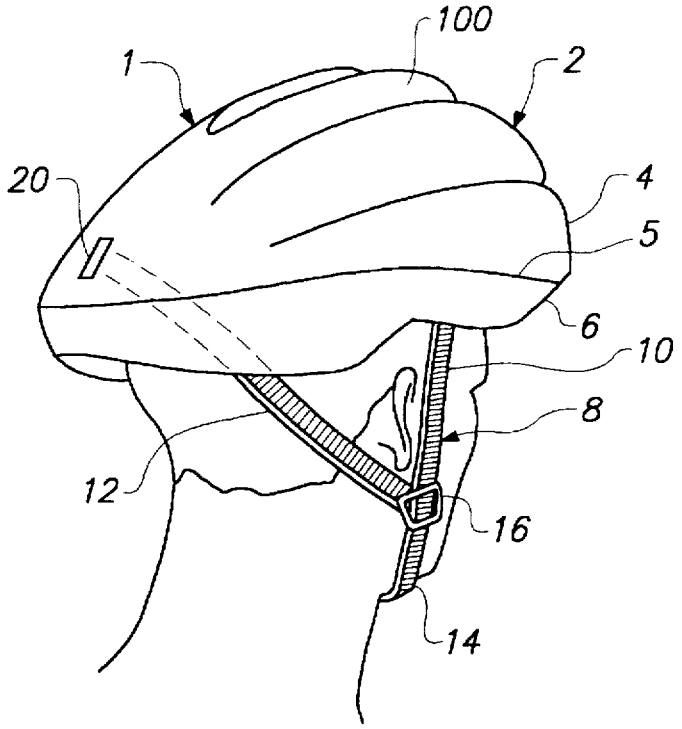
FIG. 1A (PRIOR ART)
FIG. 1A is a rear right side perspective view of a prior art helmet retention system.

Referring now to FIGS. 1A–3C, there is shown an exemplary helmet body 2. Helmet body 2 comprising crown portion 4 generally located above line 5 and skirt portion 6 generally located below line 5. Crown portion 4 in use rests upon and generally covers the upper portion of the user's (i.e., cyclist's) head. Skirt portion 6 in use extends downward to some extent over the sides and the rear of the user's head. The skirt provides for extension downward of helmet material for protection along the sides and rear of the user's head. Generally, crown portion 4 is at least partially covered by shell 100 of a harder polymeric material shaped and cut to conform to the outer surface of the crown portion of the helmet body. The shell can help to stabilize the structure of the helmet body under impact, and improve the protective value and appearance of the helmet.

With reference initially to FIGS. 1B, 2B, 3B, 3C, 11A, 11B and 11E, the cycling helmet 1 according to one embodiment of the present invention includes helmet body 2, and rear stabilizer (i.e., support member) 3 as part of retention system 40. The capacity of the helmet for head protection is enhanced by securely fastening it to the user's head so that it stays in place upon impact. The helmet is preferably held in place by retention system 40, including support arm 3. Helmet retention system 40 with support member (i.e., rear stabilizer) 3 of the present invention provides a more comfortable and secure fit of the helmet on the user's head by lowering the contact points between the user's head and each of the rear straps from the locations shown in FIGS. 1A, 2A and 3A to below the occipital protuberance of the user's head and/or spreading out the contact points across the nape of the user's neck. Locating the rear straps below the occipital protuberance provides better retaining of the helmet on the user's head in the event of a crash. The positioning of the rear straps in accordance with the present invention largely eliminates the tendency of the helmet to tilt forward on the user's head during extended periods of use or when encountering bumpy terrain. In addition, the rear stabilizer is sufficiently rigid to prevent a user from placing or wearing the helmet tilted too far back on the user's head. The rigidity of the rear stabilizer helps to ensure that the user places the helmet square on their head. The proper position of the helmet is to have the forward edge of the helmet just above the eye brows of the user such that the user is provided with good protection but can still see forward safely. Before discussing support member 3 of the present invention, a discussion of the rest of the retention system will be provided so that the function of the support member can be better understood.

Retention system 40 generally comprises an adjustable arrangement that passes down from the helmet in front of and behind the ear on each side of the user's head, and that meets in front of and beneath the user's ears and passes under the chin. Such general strap arrangements are generally known in the art, and are subject to variation and improvement. For ease of discussion and understanding, the helmet retention system will be described as a collection of straps or strap sections but as one of ordinary skill in the art will recognize the preferred helmet retention system is formed from a unitary, continuous strap that is woven throughout the system so that there are no stitched, glued, stapled, etc. joints that could separate easily in the event of an impact condition. There is no "weak link in the chain" so to speak. However, it is contemplated that the helmet retention system for use in the present invention could be formed from a collection of separate and/or joined straps.

Figure 2A:
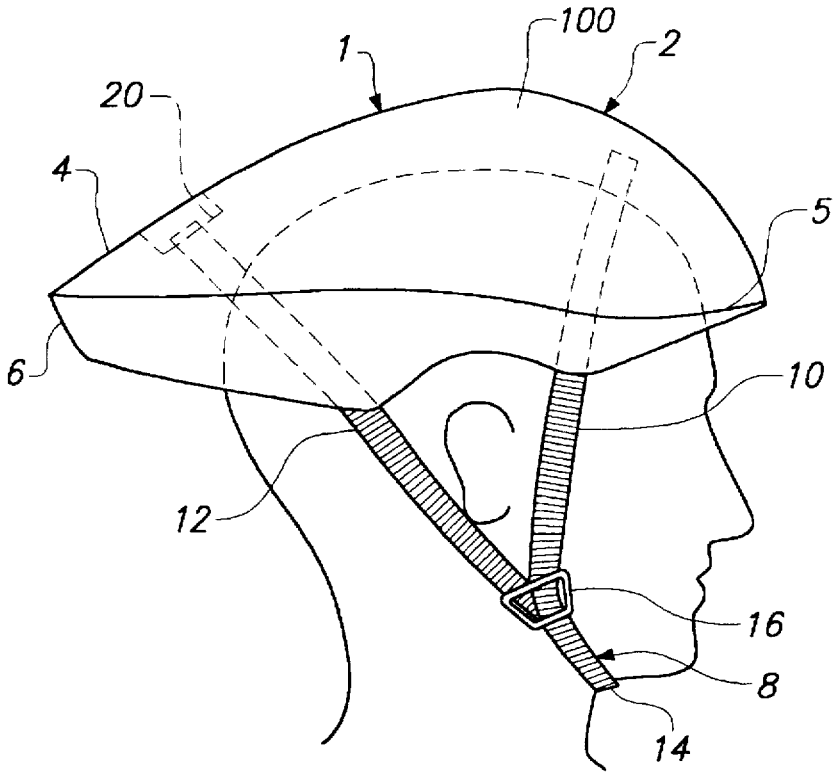
FIG. 2A (PRIOR ART)
FIG. 2A is a right side elevational view of the prior art helmet retention system of FIG. 1A.
Figure 3B:
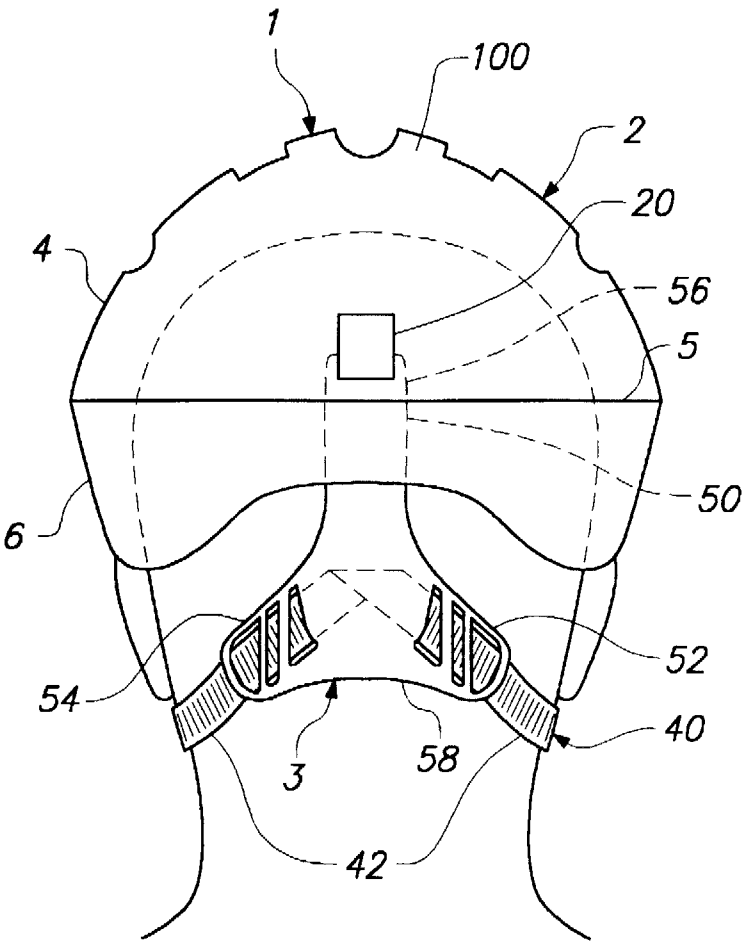
FIG. 3B is a rear elevational view of the helmet retention system of FIG. 1B.
Figure 3A:
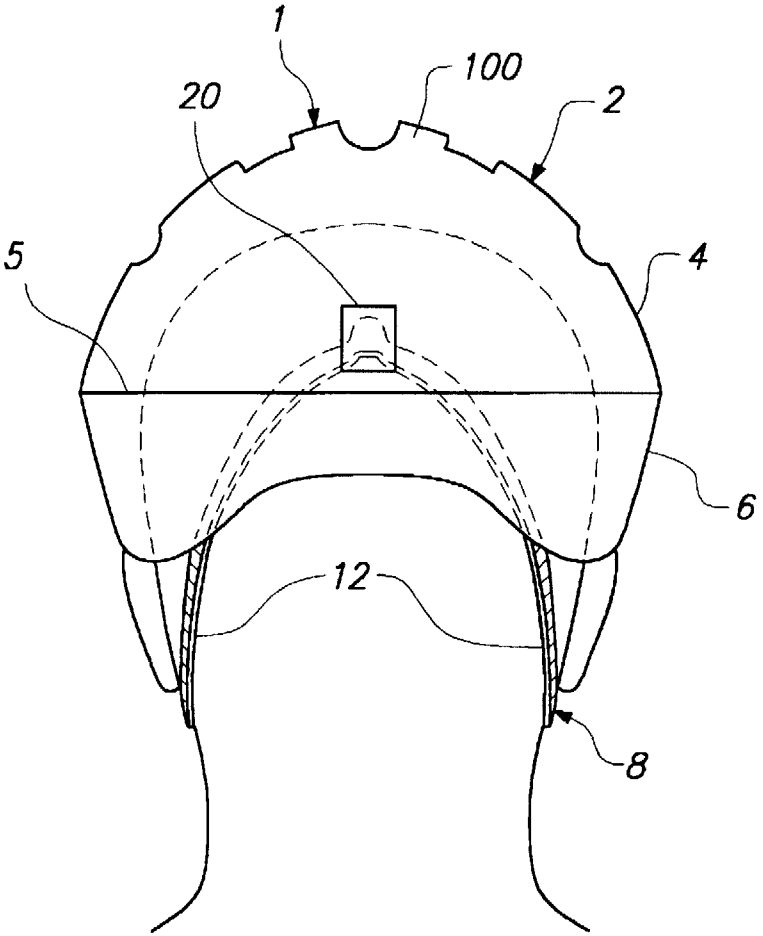
FIG. 3A (PRIOR ART)
FIG. 3A is a rear elevational view of the prior art helmet retention system of FIG. 1A.

With reference now particularly to FIGS. 1A, 2A and 3A, retention system 8 of the prior art is generally provided with a transverse groove (not shown) in the helmet body passing over the top, front portion of the helmet body under the shell and cavity 20 at the rear of the helmet body located on the centerline of the helmet into which rear strap 10 is inserted and anchored. Front strap 12 passes from below and within the helmet body up and out through an opening in the helmet body, across the top of the helmet body in the transverse groove, and down and back through the helmet body through an opening on the other side of the helmet body.

Cavity 20 passes generally upwardly through a rearward portion of the helmet body. An impression in the upper surface of the helmet body at the point where cavity 20 emerges accommodates an anchor (not shown) over which rear strap 12 passes. The rear strap passes from its junction with the front strap on the right side of the user's head, up through cavity 20, over the anchor and back down through cavity 20 to its junction with the front strap on the left side. Chin strap 14 extends between junction point 16 on the right side of the user's head under the chin to a junction point (not shown) on the left side of the user's head. The chin strap can be provided with an adjustment mechanism and buckle under the user's chin or near one of the junction points.

As can be seen in prior art FIGS. 1A, 2A, and 3A, the routing of rear strap 12 passes very close to the user's ear (often times rubbing the user's ear during use) and high across the user's head. The contact points of the rear straps for the prior art configuration are above the occipital protuberance (i.e., largest portion or the bulge) of the back of the user's head. With this configuration, the helmet can rattle around on the user's head during use and possibly be shifted out of place in the event of an impact.

Retention system 40 in one embodiment of the present invention is generally provided with a transverse groove (not shown) in the helmet body passing over the top, front portion of the helmet body under shell 100 and cavity 20 at the rear of the helmet body located on the centerline of the helmet into which rear stabilizer 3 is inserted. Rear stabilizer 3 can fit loosely in cavity 20 or be anchored therein as described in more detail below. Front strap 44 passes from below and within the helmet body up and out through an opening in the helmet body to engage the transverse groove across the top of the helmet body and down and back through the helmet body through an opening on the other side of the helmet body.

Cavity 20 passes generally upwardly through a rearward portion of the helmet body. An impression in the upper surface of the helmet body at the point where cavity 20 emerges accommodates a clip 22 with which a portion of rear stabilizer 3 engages. The rear strap 12 passes from its junction with the front strap on the right side of the user's head, through a lower portion of the rear stabilizer to its junction with the front strap on the left side. Chin strap 46 extends between junction point 48 (e.g., a buckle) on the right side of the user's head under the chin to a junction point (not shown) on the left side of the user's head. The chin strap can be provided with an adjustment mechanism and buckle under the user's chin or near one of the junction points as is generally known in the art. The chin strap can be a single section or be divided into two mating sections.

Generally speaking, rear strap 42, front strap 44, and chin strap 46 make up a strap unit. The strap units are positioned on opposite sides of the user's head and are essentially mirror images of one another. The adjustment mechanism (not shown) allows the user to tighten the retention system to the user's head. As will be described in more detail below, the adjustment mechanism and chin strap deflect the rear stabilizer or support arm 3 toward the back of the user's head when the straps of the retention system are tightened.

Figure 2B:
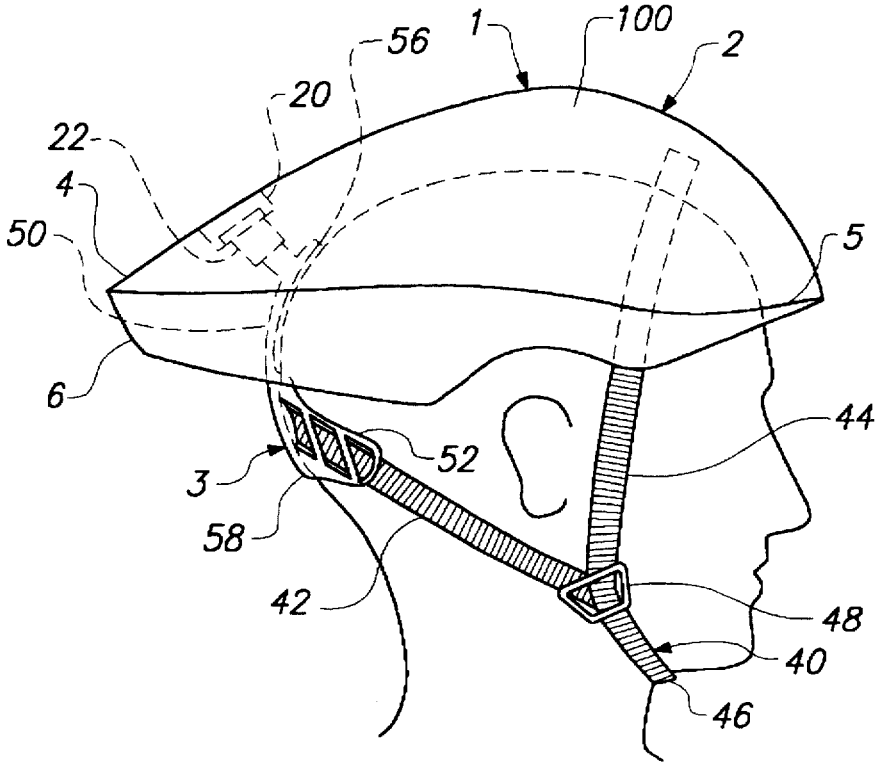
FIG. 2B is a right side elevational view of the helmet retention system of FIG. 1B.
Figure 11A:
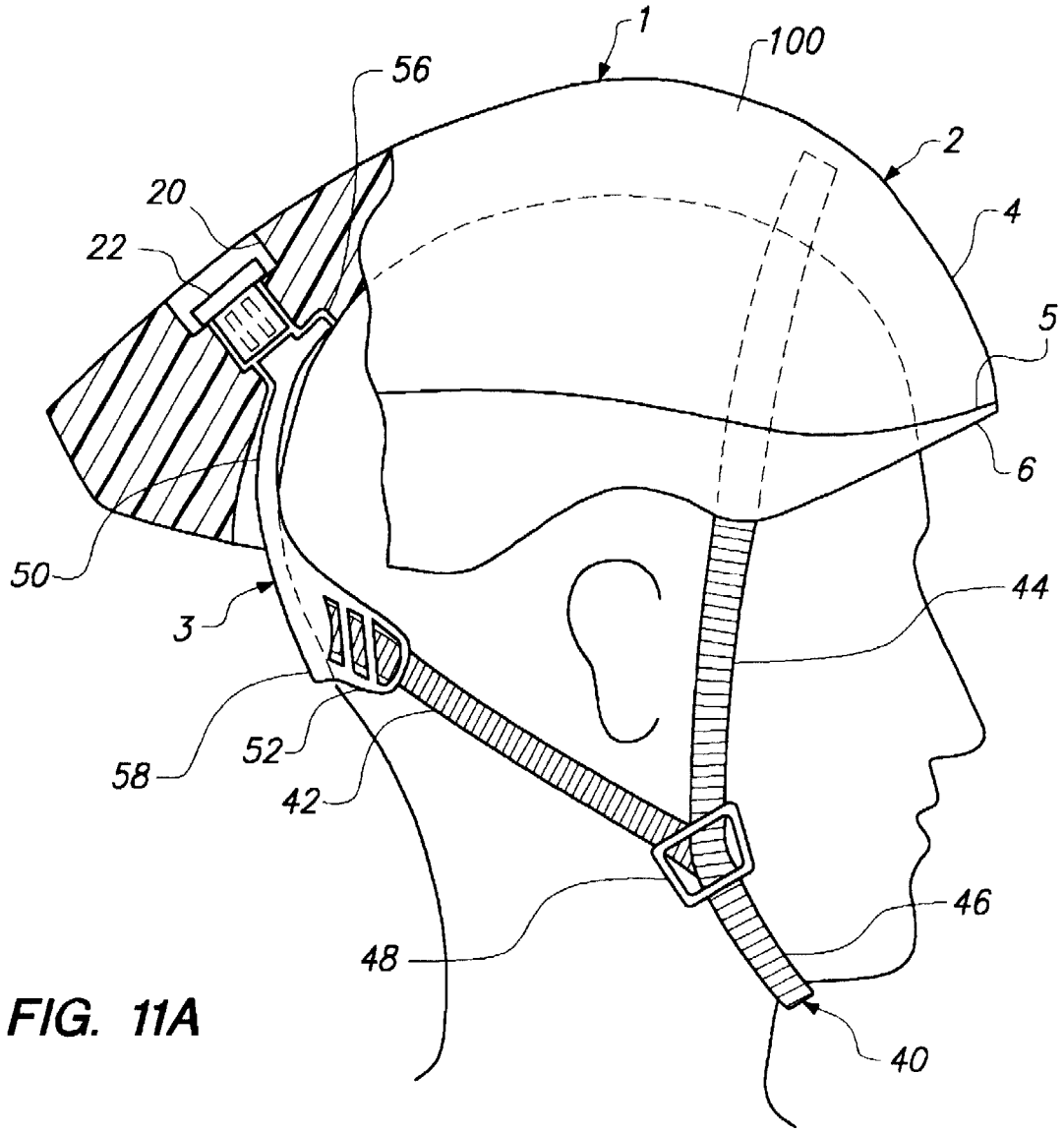
FIG. 11A is a right side elevational view, partially in section, of a helmet retention system in accordance with one embodiment of the present invention.

With reference to FIGS. 4–10A, support member or rear stabilizer 3 includes base 50 and arms 52,54. Stabilizer 3 resembles an inverted "Y", as shown in the figures, however, other shapes such as an "I", "A", "H", triangle, inverted "T", etc. are all within the scope of the present invention. Base 50 is attached at end 56 to the rear portion of the helmet body and has an opposite free end 58. As seen in FIGS. 2B and 11A, rear stabilizer 3 is attached to the rear portion of helmet body 2 with retention clip 22.

Retention clip 22 (FIGS. 9, 10 and 11A) is comprised of flanged base 24 having extension 26 extending perpendicularly therefrom. Extension 26 has two ribbed cylinders 28 extending therethrough. Ribbed prongs 60 extend outward from rib extension 30 located at end 56 of base 50. Ribbed prongs 60 of stabilizer 3 are inserted from the inside surface of the helmet body toward cavity 20. Retention clip 22 is inserted in cavity 20 from the outside of the helmet body. Ribbed cylinders 28 and ribbed prongs 60 interlock in a friction fit manner so as to "sandwich" a portion of the helmet body between flanged base 24 and end 56 of stabilizer 3. Preferably, in one embodiment, the stabilizer 3 is rigidly and firmly attached to the rear portion of the helmet by the "sandwiching" of the helmet body between the flanged base 24 and end 56 of stabilizer 3. Flanged base 24 and end 56 of stabilizer 3 generally have broad surfaces so as to distribute impact forces over a broader portion of the helmet body to prevent stabilizer 3 from being torn away from the helmet body in the event of an impact. In another embodiment, retention clip 22 (FIG. 10A) is comprised of flanged base 24 having extension 26 extending perpendicularly therefrom. Extension 26, in this embodiment, has a cavity 29 with at least one rib (not shown) therein. Ribbed extension 61 (FIG. 6B) extends outward from rib extension 30 located at end 56 of base 50. Ribbed extension 61 of stabilizer 3 is inserted from the inside of the helmet body and interlocks in a friction fit manner with cavity 29 so as to "sandwich" a portion of the helmet body between flanged base 24 and end 56 of stabilizer 3. In other embodiments, stabilizer 3 can also be attached to retention clip 22 such that the stabilizer attaches loosely to the rear portion of the helmet body to allow some movement of the stabilizer through the helmet body.

Figure 1B:
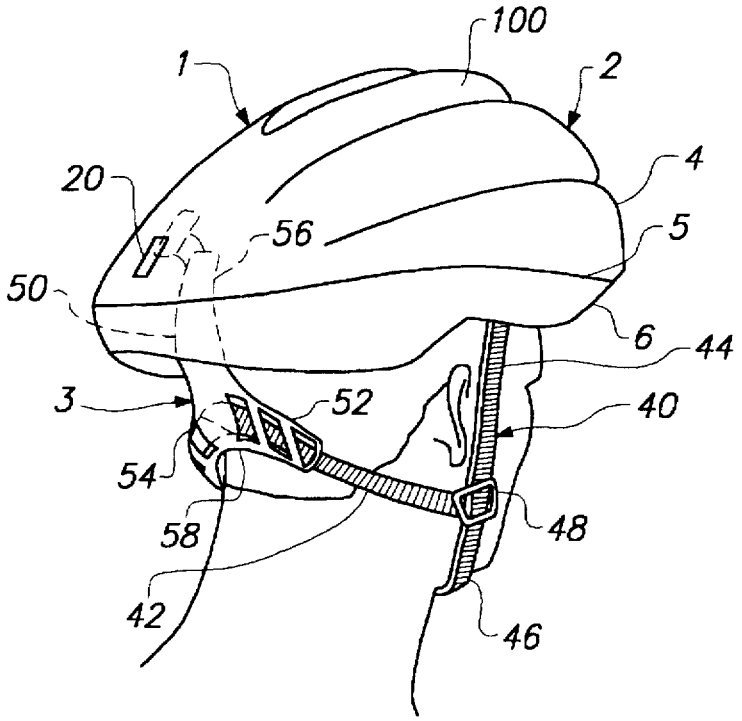
FIG. 1B is a rear right side perspective view of one embodiment of a helmet retention system in accordance with the present invention.
Figure 8:
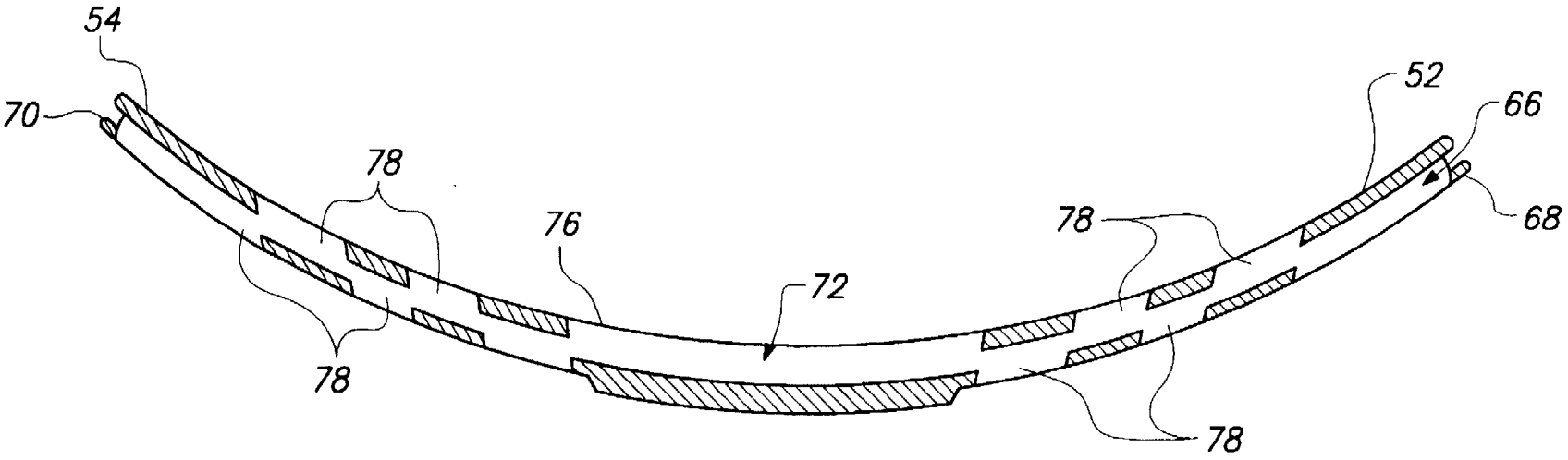
FIG. 8 is a sectional view taken along line 8—8 in FIG. 4 of the retention arms in accordance with one embodiment of the present invention.
Figure 9:
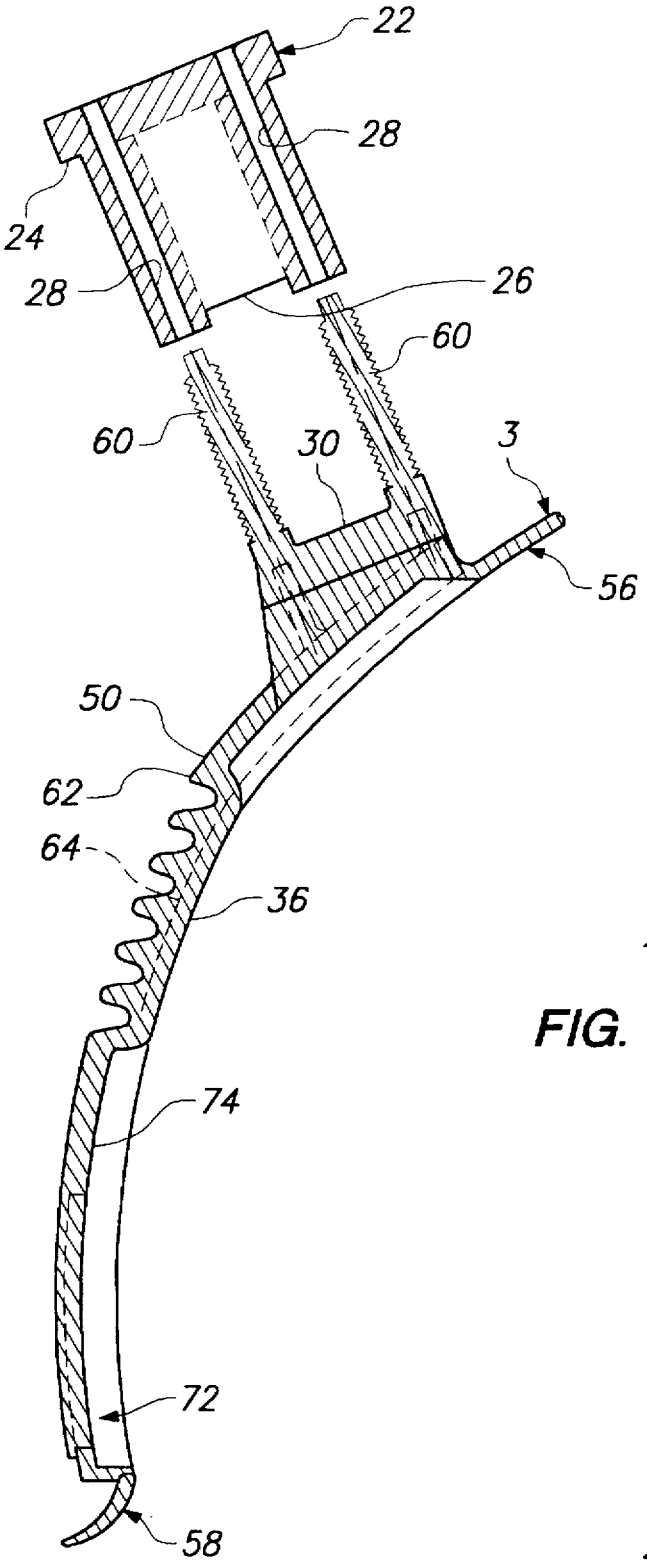
FIG. 9 is a sectional view taken along line 9—9 in FIG. 4 of the support member and including a retaining clip in accordance with one embodiment of the present invention.
Figure 10:
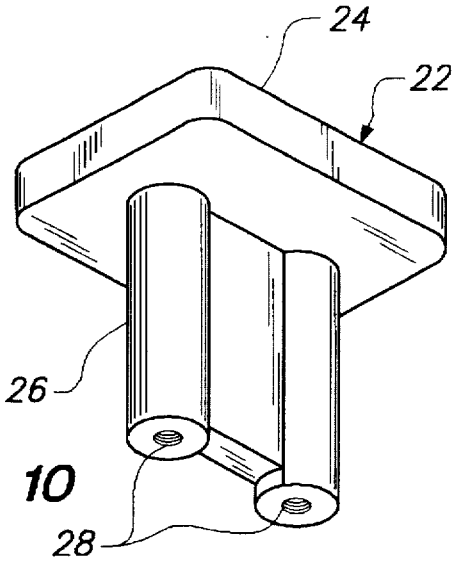
FIG. 10 is a perspective view of one embodiment of a retaining clip in accordance with the present invention.
Figure 10A:
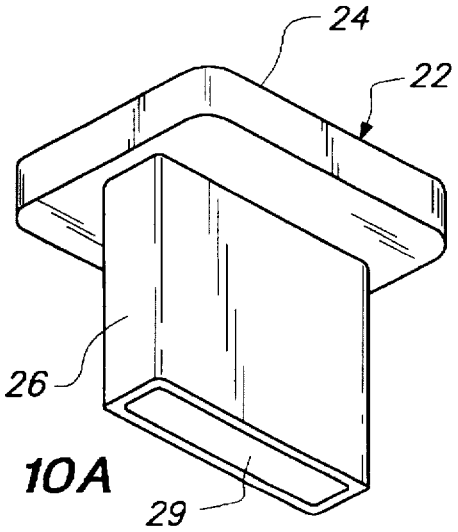
FIG. 10A is a perspective view of an alternate embodiment of a retaining clip in accordance with the present invention.

In one embodiment, arms 52, 54 are provided with tunnel 66 (as best seen in FIG. 8) that passes from end 68 of arm 52 through junction area 72 to end 70 of arm 54. Rear strap 42 is threaded through tunnel 66 from end 68 up to junction area 72. A recess 74 is provided in junction area 72 so that rear strap 42 can be folded over on itself (i.e., twisted, as can be seen in FIGS. 1B and 3B) and then threaded through tunnel 66 in arm 54 out through end 70. Plurality of openings 78 on either side of tunnel 66 add to the flexibility of the arms, as well as making it easier to thread the strap through the stabilizer.

Base 50 preferably has a curve or bend 36 shaped to curve around the occipital region of the user's head. Curve 36 assists in positioning the rear straps of the helmet retention system below the occipital protuberance of the user's head. In one embodiment, rear stabilizer 3 is sufficiently long to position the rear straps across the nape of the neck. Base 50 is biased (i.e., tending toward one direction) and/or orientated toward the front of the helmet by curve 36 such that rear stabilizer 3 at least partially cradles or conforms to the back of the user's head and/or neck without the user having to snug the retention straps. The stabilizer can also be shaped and/or biased such that it places a desired amount of pressure against the back of the user's head and/or neck without the user having to snug the retention straps. In some embodiments, a certain amount of pressure is desirable for user reassurance. Curve 36 results in base 50 being more flexible toward the front portion of the helmet body than in a direction away from the front portion.

Figure 6:
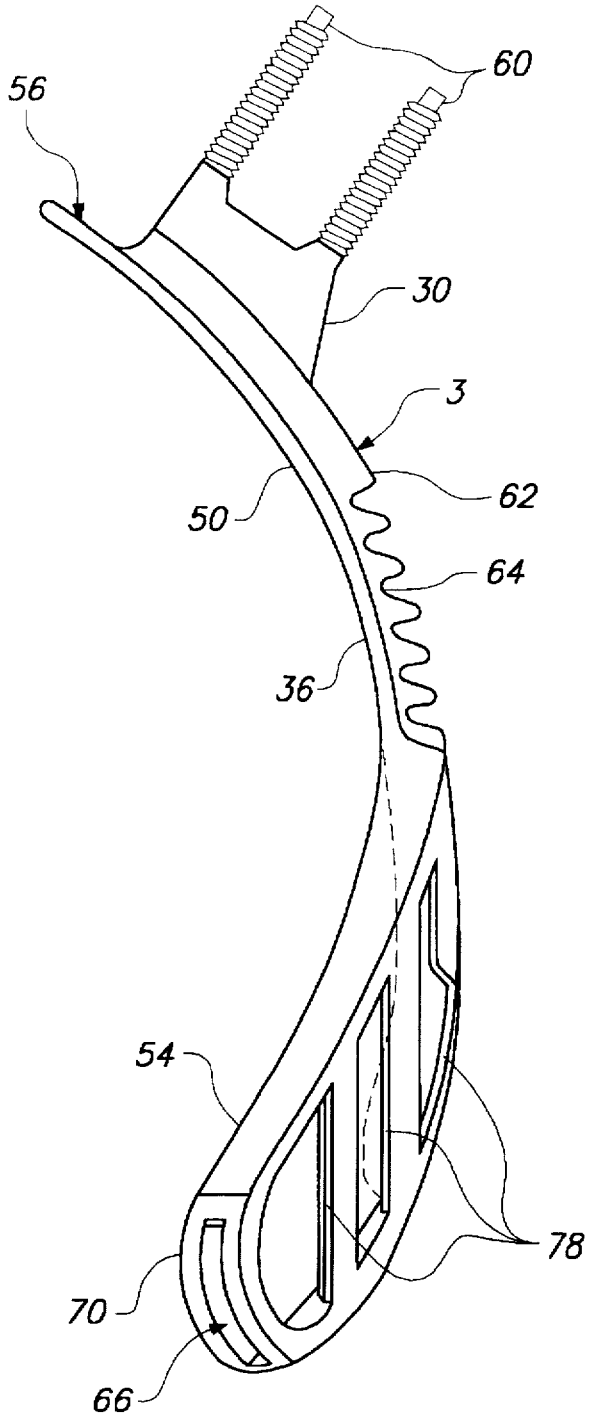
FIG. 6 is a right side elevational view of the support member of FIG. 4.
Figure 6A:
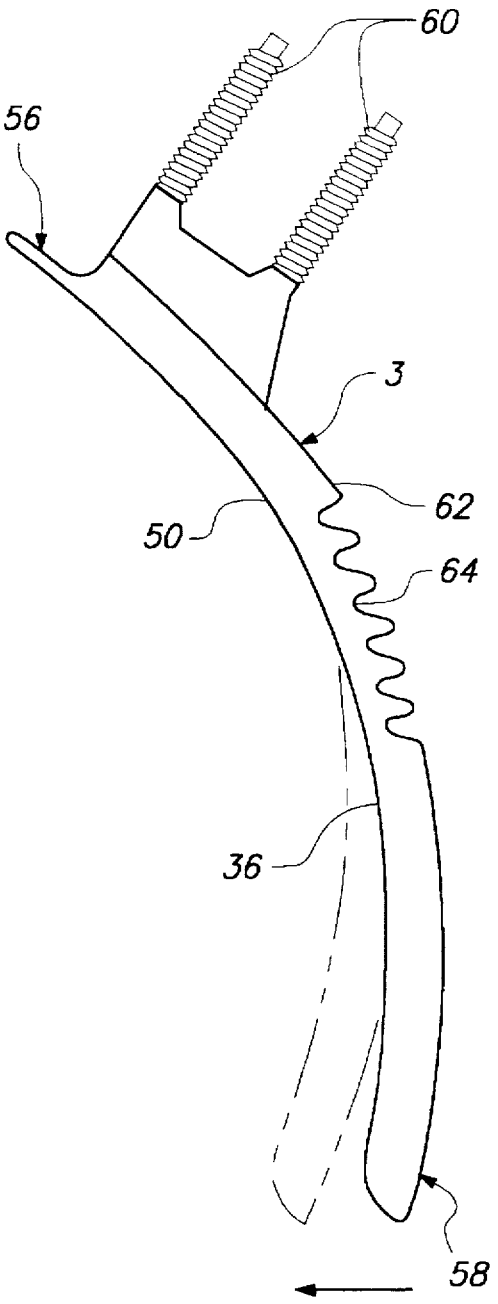
FIG. 6A is a schematic diagram of the support member of FIG. 4 showing movement of a mounting arm portion of the support member.
Figure 6B:
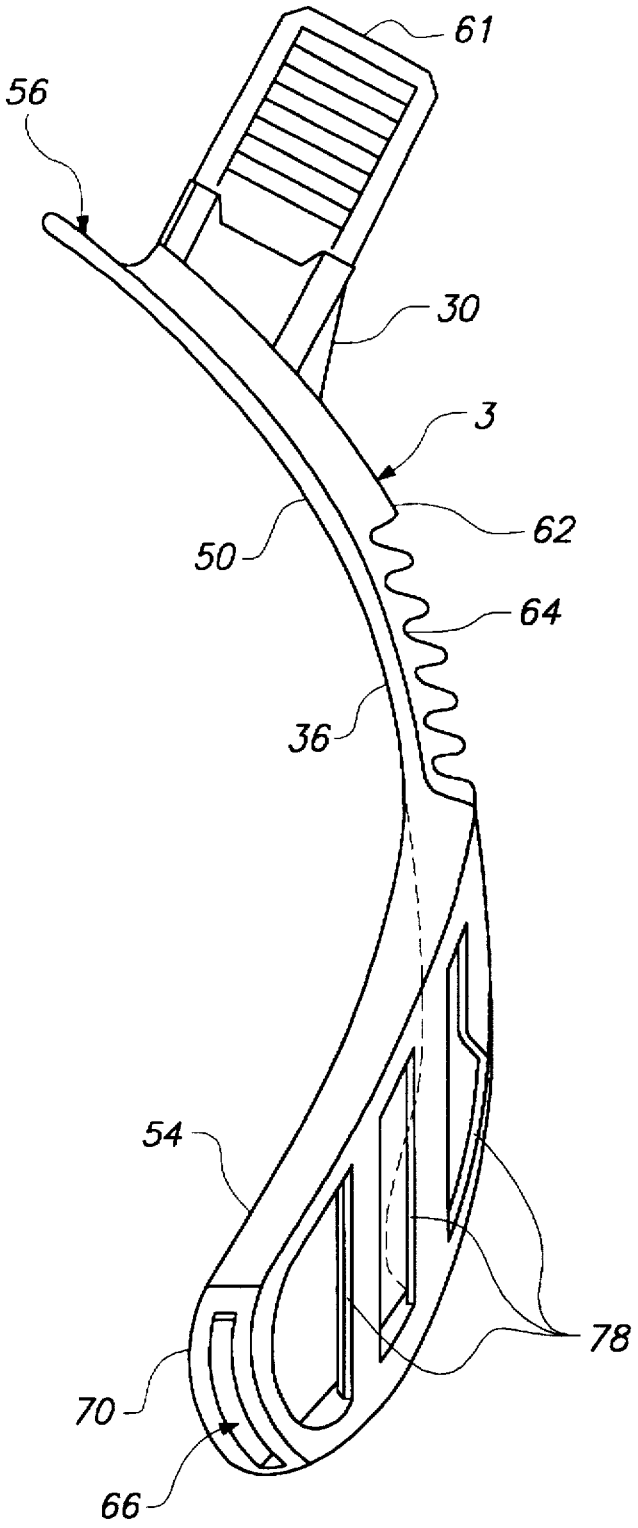
FIG. 6B is a schematic diagram of an alternate embodiment of the support member of FIG. 4.

Rib 62 is mounted along the outer surface of base 50 from end 56 to approximately the beginning of arms 52,54 to make the rear stabilizer semi-rigid (i.e., semi-flexible) and/or resilient (i.e., elastic). In one embodiment, rib 62 is provided with a series of transversely orientated grooves or slots 64. Grooves 64 allow base 50 of rear stabilizer 3 to be deflectable (i.e., semi-flexible, pliant, bendable, and/or deformable) such that the user can snug the rear stabilizer to the back of the user's head and/or neck by tightening the retention straps. When the user tightens the retention straps, rear straps 42 deflect base 50 toward the back of the user's neck and head as shown in FIG. 6A. In addition, the distance between the inside surface of the front portion of the helmet body and the rear stabilizer is generally less than is required for admission of a user's head such that the stabilizer is often times deflected rearward when the user's head is admitted.

Figure 7:
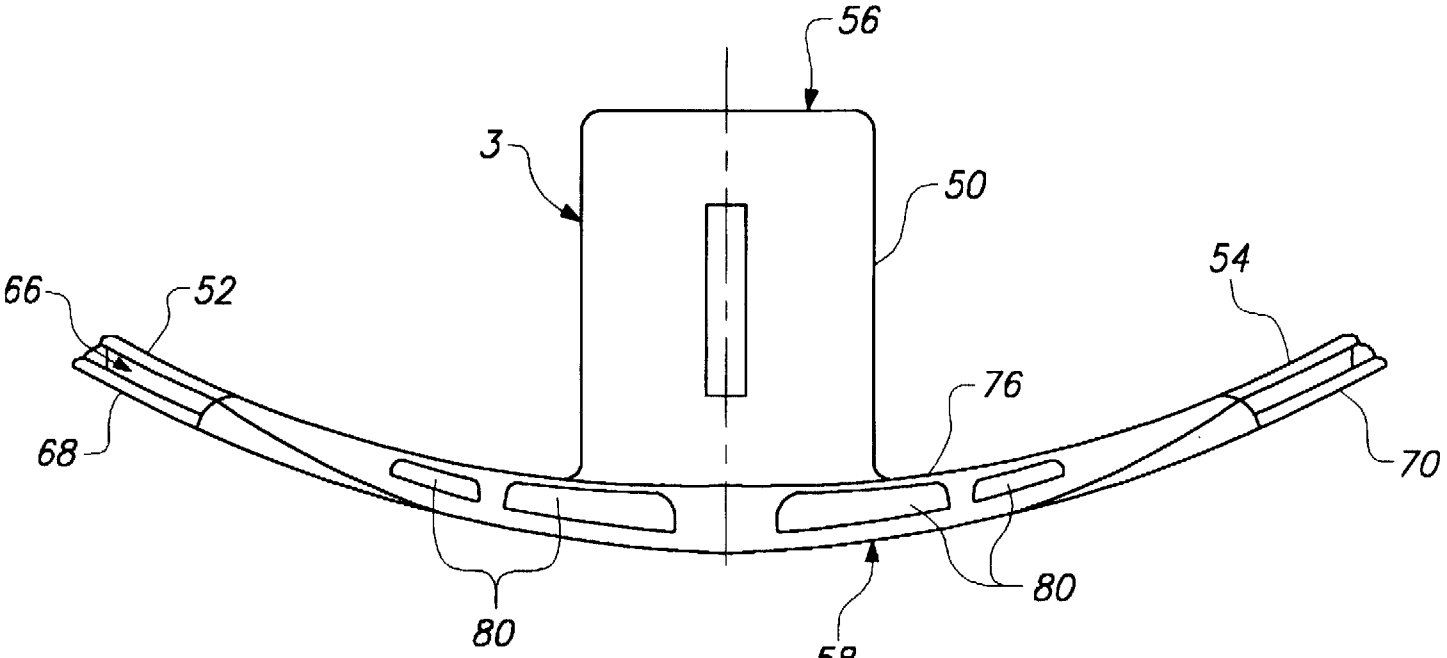
FIG. 7 is a bottom plan view of the support member of FIG. 4.
Figure 7A:
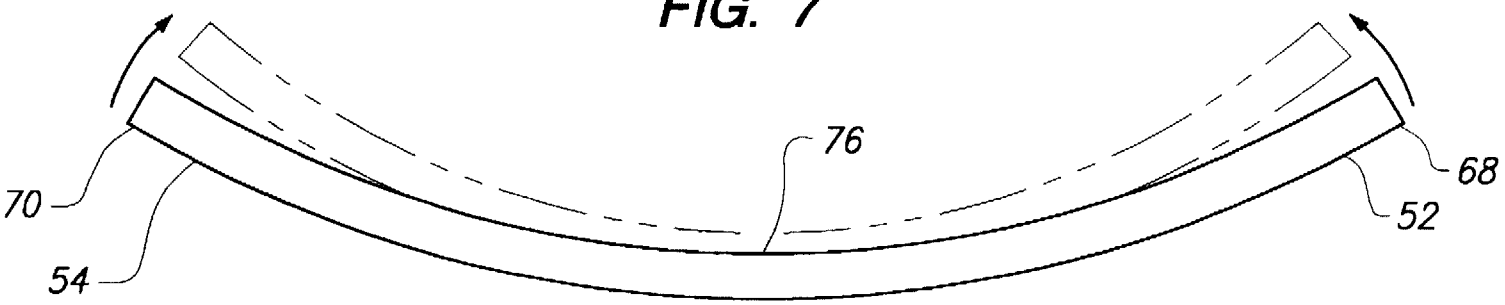
FIG. 7A is a schematic diagram of the support member of FIG. 4 showing movement of the retention arms of the support member.

In a similar fashion, arms 52,54 have a curve or bend 76 shaped to curve around the nape and/or head of the user. Arms 52,54 extend around curve 76 to position the contact points of the rear straps of the helmet retention system laterally across and below the occipital protuberance of the user's head. Arms 52,54 are biased (i.e., tending toward one direction) and/or orientated toward the front of the helmet by curve 76 such that rear stabilizer 3 at least partially cradles or conforms to the back of the user's neck and/or head without the user having to snug the retention straps. Arms 52,54 are deflectable (i.e., semi-flexible, pliant, bendable, and/or deformable) such that the user can snug the arms to the back of the user's neck and/or head by tightening the retention straps. When the user tightens the retention straps, rear straps 42 deflect ends 68 and 70 of arms 52 and 54 toward the back of the user's neck and/or head as shown in FIG. 7A. Arms 52,54 are at least as deflectable as base 50, preferably being more deflectable than the base so that when the user tightens the retention system ends 68 and 70 of arms 52 and 54 deflect toward the back of the user's neck and/or head before the base deflects toward the back of the user's head.

Rear stabilizer 3 may be made of a plastic material such as nylon which is semi-flexible and provides some resiliency to the rear stabilizer. As part of the retention system, rear stabilizer 3 has sufficient strength to withstand the forces of impact as a result of a crash by the user. The rear stabilizer is preferably made of an energy absorbing, semi-rigid plastic material such as "super tough nylon," high impact polypropylene, high impact polyvinylchloride, or the like. A semi-rigid material offers the advantage that the rear stabilizer will assume a particular predetermined shape when not under tension. In other words, the rear stabilizer retains its predetermined shape when it is not experiencing a load and is not easily deformed with small forces (i.e., it is not floppy). This gives a better appearance and a more reproducible feel to the helmet each time it is put on or taken off. Plurality of openings 80 in stabilizer 3 make the stabilizer more lightweight and can provide for flexibility in desired locations on the stabilizer.

Figure 3C:
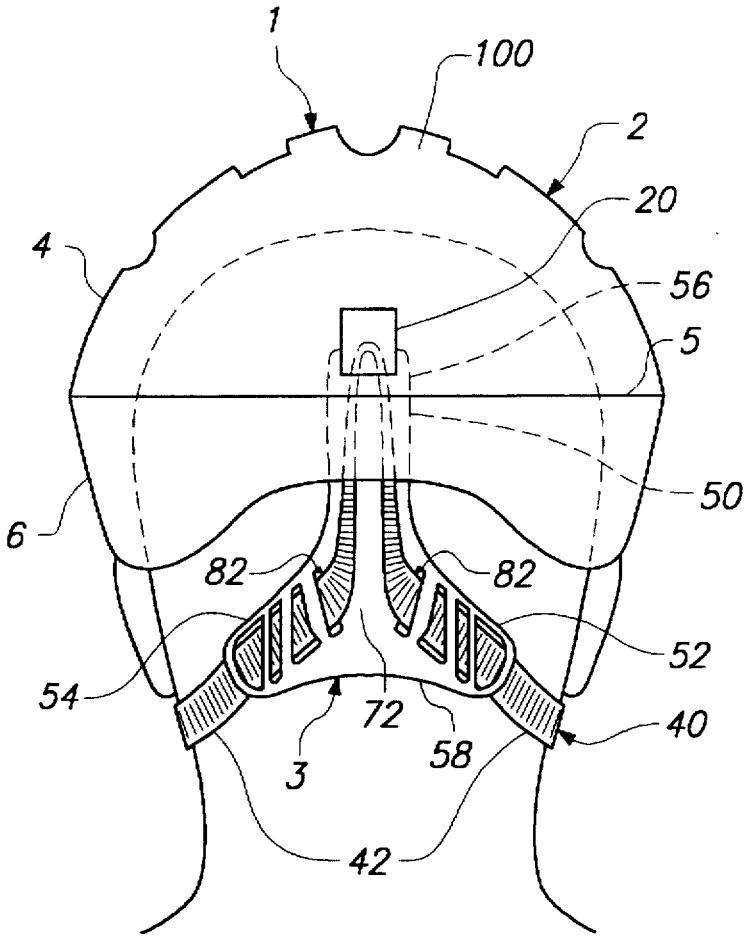
FIG. 3C is a rear elevational view of another embodiment of a helmet retention system in accordance with the present invention.
Figure 4:
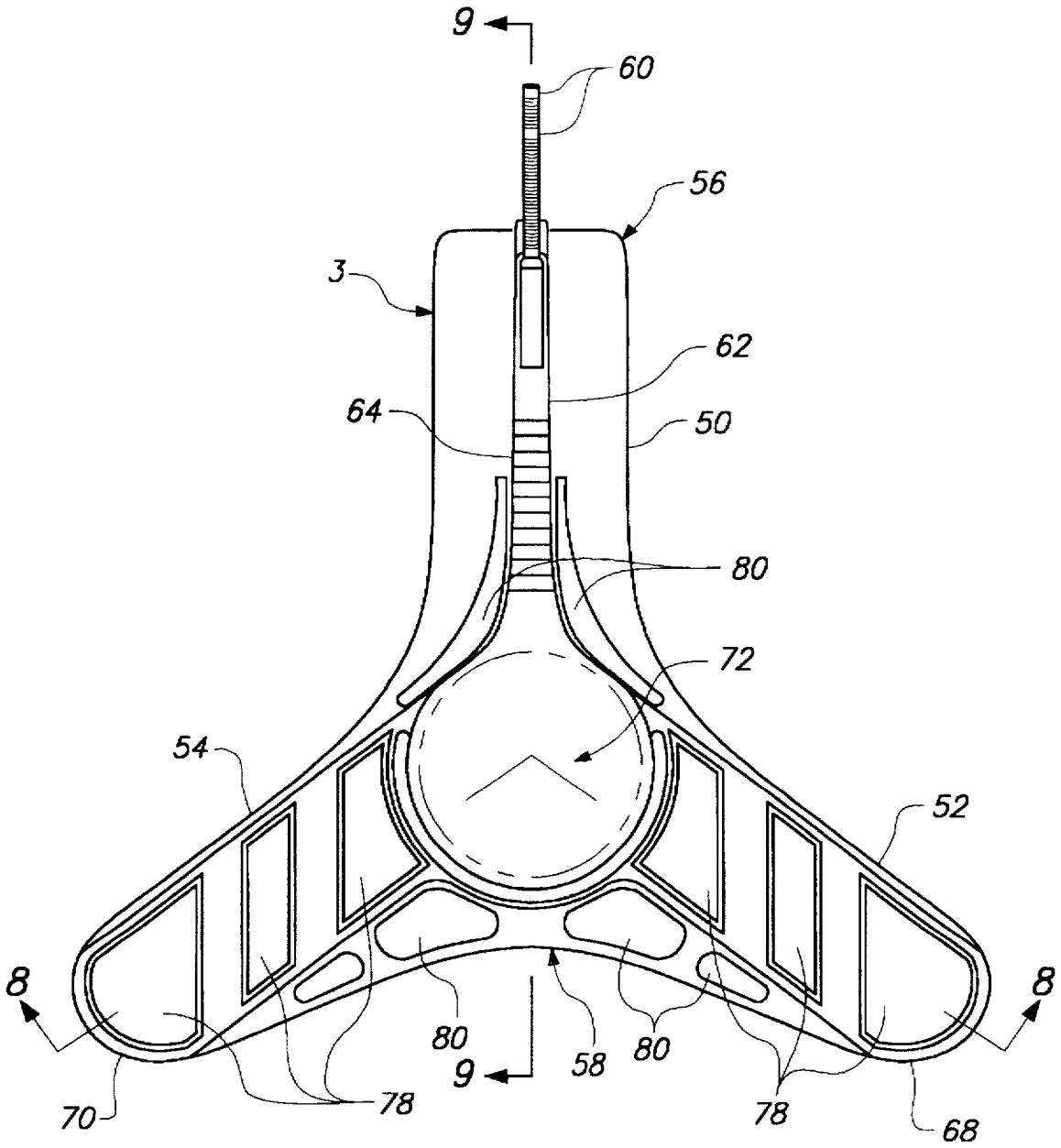
FIG. 4 is a rear elevational view of one embodiment of a support member in accordance with the present invention.
Figure 5:
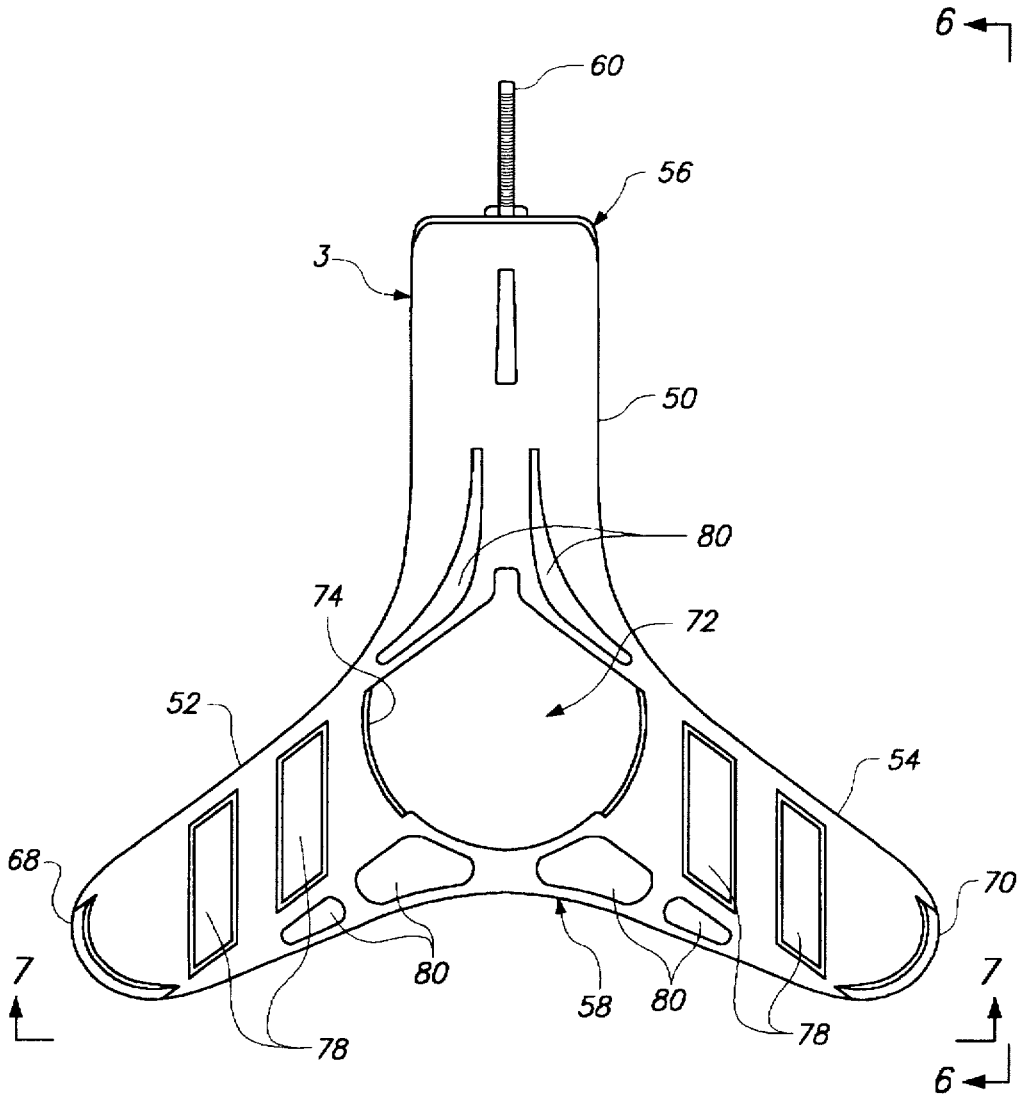
FIG. 5 is a front elevational view of the support member of FIG. 4.

FIG. 3C shows one alternative embodiment of the stabilizer in accordance with the present invention. Recess 74 described earlier has been replaced with slotted openings 82 near the junction area 72. Slotted openings 82 allow a longer rear strap 42 to be extended up to the rear portion of the helmet body such that it can be anchored to the helmet in a manner generally known in the prior art (e.g., using the anchor as described with respect to FIGS. 1A, 2A and 3A). This configuration adds additional strength to the helmet retention system in the event of a significant impact.

Figure 11B:
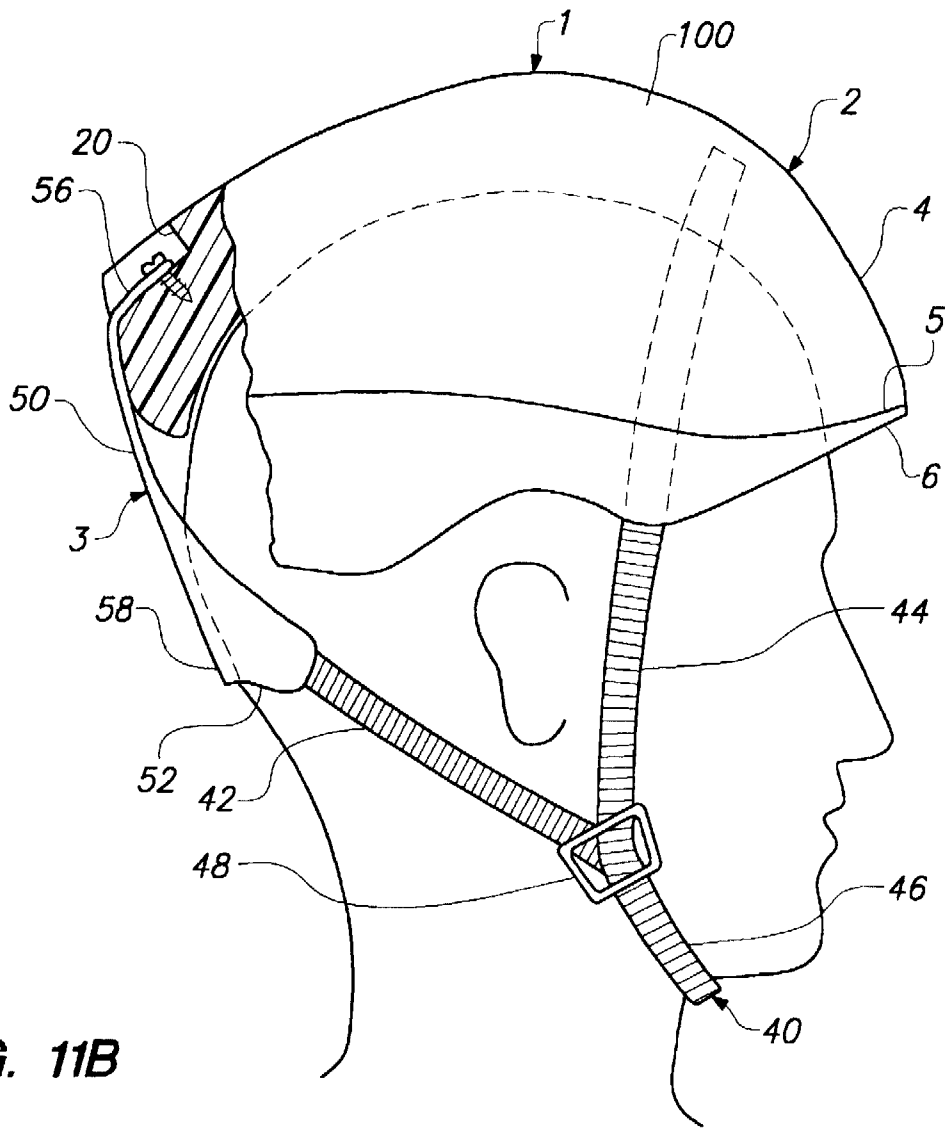
FIG. 11B is a right side elevational view, partially in section, of a helmet retention system in accordance with another embodiment of the present invention.

FIG. 11B is yet another embodiment of the stabilizer in accordance with the present invention. Stabilizer 3 in FIG. 11B is mounted to the exterior of the helmet body. In the particular embodiment shown, a screw is used to mount the stabilizer, but it will readily be appreciated many other fasteners and methods can be used for mounting the stabilizer fly on the exterior of the helmet. For example, in FIG. 11E, stabilizer 3 is mounted in recess 20 in the helmet body and plug 55 is glued into the recess over end 56 of the stabilizer.

Figure 11C:
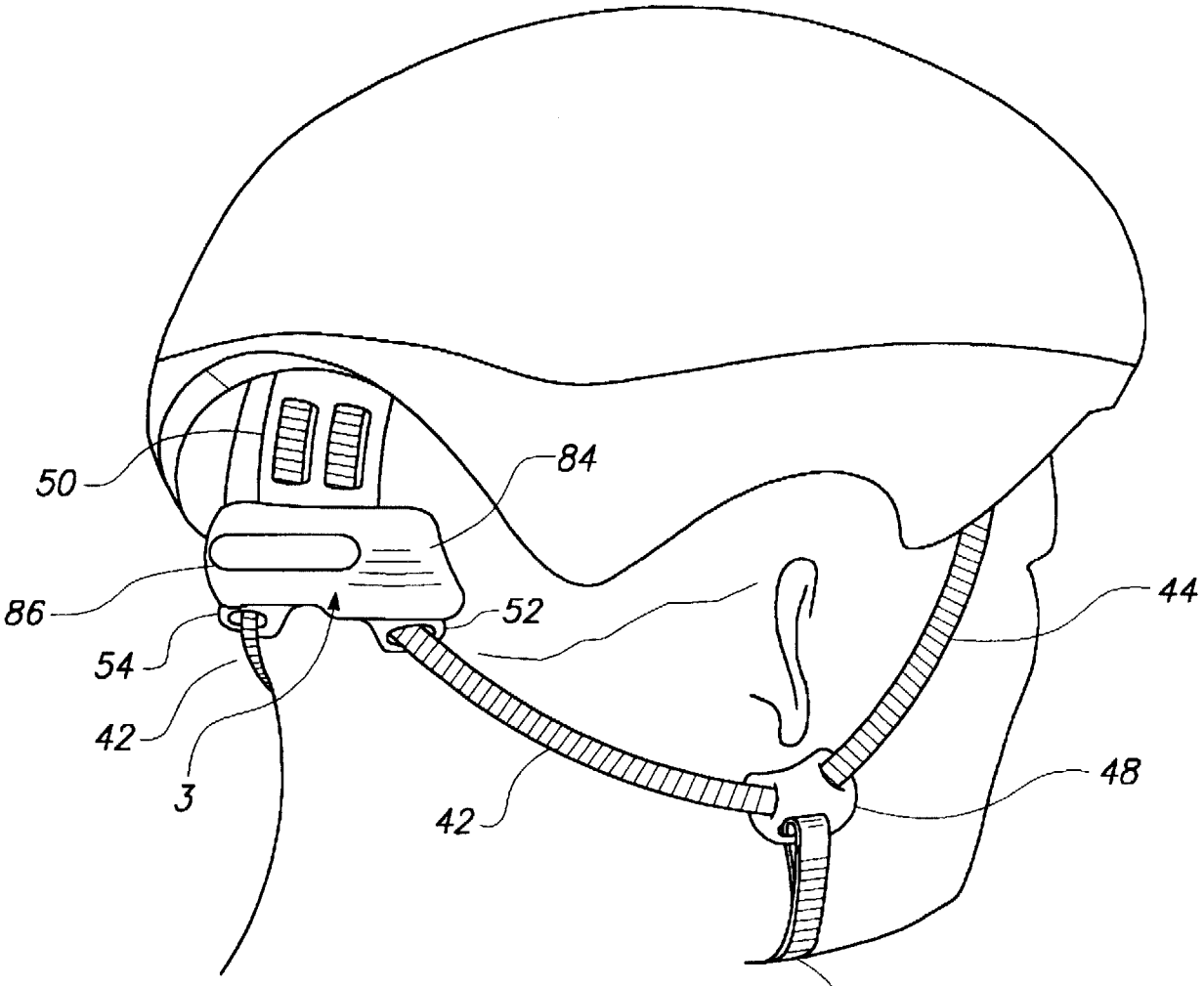
FIG. 11C is a rear right side perspective view of a helmet retention system in accordance with yet another embodiment of the present invention.

FIG. 11C is still another embodiment of the stabilizer in accordance with the present invention. Rear strap 42 is threaded through slots in base 50 and extended up to the rear portion of the helmet body such that it can be anchored to the helmet in a manner generally known in the prior art (e.g., using the anchor as described in conjunction with FIGS. 1A, 2A and 3A). Molded impact pad 84 is attached to arms 52,54 to provide additional protection to the rear of the user's head in the event of an impact to that area. Reflector 86 can also be provided for additional night safety.

Figure 11D:
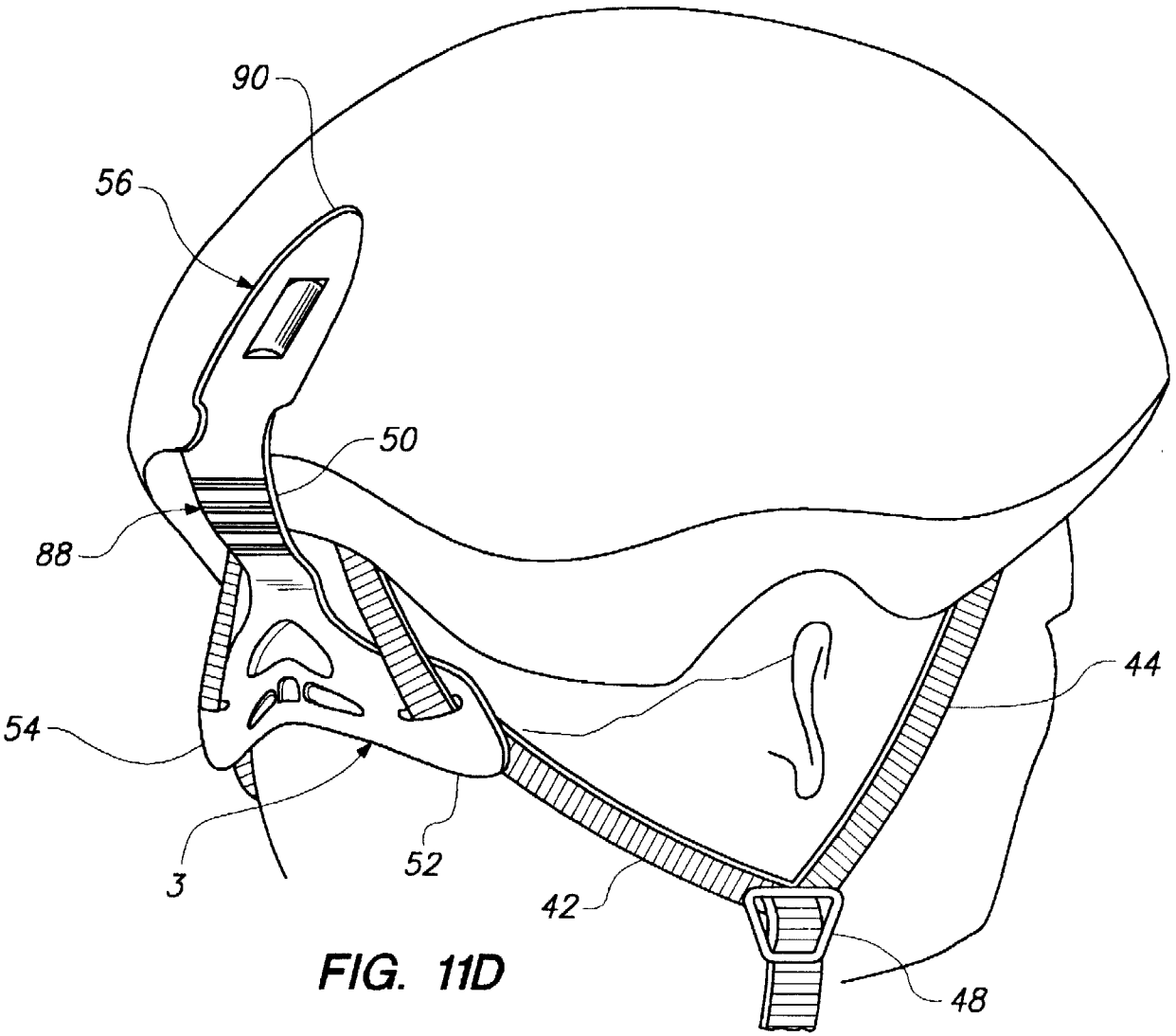
FIG. 11D is a rear right side perspective view of a helmet retention system in still another embodiment of the present invention.
Figure 11E:
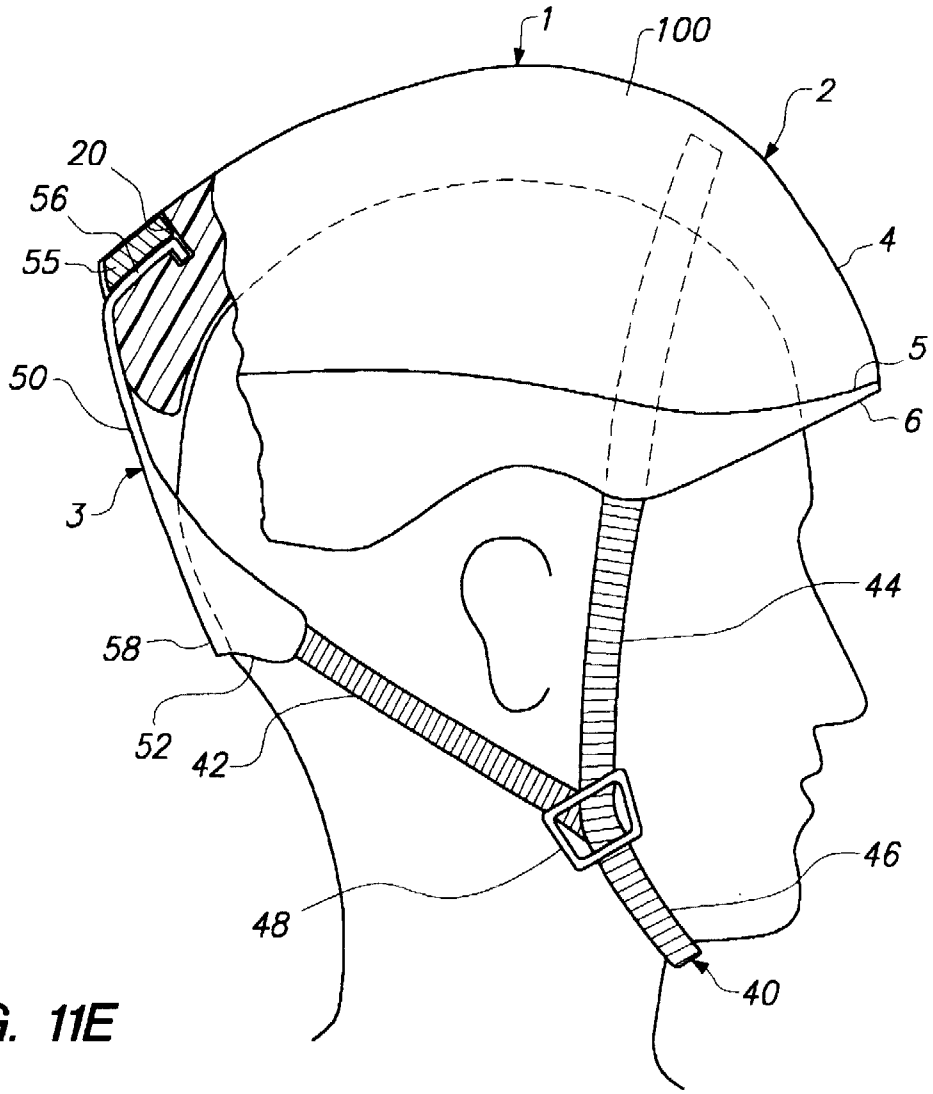
FIG. 11E is a right side elevational view, partially in section, of a helmet retention system in accordance with another embodiment of the present invention.

FIG. 11D is another embodiment of the stabilizer in accordance with the present invention. As with the embodiment shown in FIG. 3C, a longer rear strap 42 is extended up to the rear portion of the helmet body such that it can be anchored to the helmet. In this embodiment, rear strap 42 loops through two slots in end 56 and over a center piece to help hold the rear stabilizer to the helmet in the event of impact. The stabilizer can be taped into recess 90 and held in place by adhesive and the rear strap. Flex adjustment 88 can also be provided in stabilizer 3. In one embodiment, the flex adjustment comprises a series of channels extending across the base 50. Any number of flex stops, typically cylindrical members that fill the channels, can be added to the flex adjustment to achieve varying degrees of rigidity. Likewise, any number of flex stops can be removed to achieve varying degrees of flexibility.

From the foregoing, it can be readily appreciated that in addition to the advantages mentioned above that the helmet according to the present invention provides the cyclist with a snug fitting protective helmet which does not rattle while traveling over rough terrain. Additionally, the semi-flexible nature of the rear stabilizer provides the potential for allowing the same size helmet to be worn by individuals having different head sizes.

A close fit of the helmet to the user's head is important for providing protection from impact. In preferred embodiments, a fit system comprised of a set of pads is provided within the helmet to provide comfortable and stable points of contact of the helmet with the user's head. A rear pad (not shown) on the interior surface of the helmet body provides for a comfortable contact between the helmet and the midparietal region of the head, and a front pad (not shown) provides for a comfortable contact between the helmet and the frontal region of the head. These pads additionally have the effect of holding portions of the inner wall of the helmet slightly away from the skin of the head. Preferably, the pads are a sandwich construction, filled with a soft resilient polymer layer, such as a polyester foam. They can be provided on the hair and skin-contacting surface with a breathable material such as the material marketed by Malden Mills under the name Polartech™. The pads are preferably held in place in the helmet by hook-and-loop fasteners, such as are known generally under the trademark Velcro®. The hook elements can be affixed using for example a pressure-sensitive adhesive at selected points in the helmet body, and the pads can be provided on the helmet-facing surface with, for example, a brushed nylon that adheres well to the hook elements.

Generally, a helmet according to the present invention can be fabricated using techniques known in the art. The helmet body can be constructed of any firm, lightweight material. Preferred materials includes gas-expandable synthetic polymers formed using molding techniques generally known in the art. Expandable polystyrene ("EPS") is a preferred expandable polymer for use in forming the helmet body according to the present invention; such polymers are commercially available, marketed for example by General Electric Company under the tradename "GE-CET". Other gas expandable polymers may alternatively be used as, for example, expandable polypropylene or urethane.

Cycling helmets in various configurations are known that include, for example, a helmet body made of gas expanded synthetic polymer and covered with a thin shell shaped and cut to conform to a portion of the helmet body surface. Likewise, shell 100 preferably is made from sheetstock of a thermoformable polymer such as a polyester teraphthylate glycol ("PETG"). Fabrication is straightforward. A form is provided, having a surface configuration corresponding to the shape of the helmet body portion to be covered by the shell. A sheet of thermoformable polymer is first heated then drawn over or into the form using vacuum or its equivalent. The formed polymer piece is then trimmed to form its peripheral edge and any vents that may be desired are cut out. The resulting trimmed and cut shell is then pulled over the completed helmet body, which it closely fits, and the shell edge is taped onto the periphery of the helmet body using an elastic tape, such as a vinyl tape having a pressure sensitive adhesive. Shell 100 may be affixed to helmet body 2 by any convenient means. The shell and body can for example be bonded together by an adhesive, such as a contact adhesive, over much of the opposed surfaces of shell and body or they can be joined only at the peripheral edge of the shell using a contact adhesive tape. The shell can be decorated by inks or pigments; to the extent the completed shell is opaque, it can hide surface irregularities and conceal the straps, giving the helmet a finished appearance. More significantly from the standpoint of safety, the shell can serve to preserve the overall integrity of the helmet even after a portion of the body has been damaged by a first impact, so that the helmet remains in place on the user's head to provide at least limited continuing protection in the event of additional impacts that may occur as the impact situation develops.

While the invention has been described in detail with reference to specific embodiments thereof, it will be apparent to one skilled in the art that various changes and modification can be made, and equivalents employed, without departing from the spirit and scope of the invention.

What is claimed is:

1. An adjustable protective helmet for a cyclist comprising:

a helmet body having a front portion and a rear portion;

a rear stabilizer having one portion mounted in the rear portion along the centerline of the helmet body and having an opposite free end, said rear stabilizer having a resilient base shaped to conform to the back of the cyclist's head or neck;

a helmet retention system for retaining the helmet body and the rear stabilizer in a desired position on the cyclist's head, said helmet retention system comprising retention strap sections engaged with the helmet body on oppositely disposed sides of the helmet body and extending downward to a point below the cyclist's ear and from that point rearward to the free end of the rear stabilizer;

said rear stabilizer extending from the rear portion of the helmet body such that at least a portion of the helmet retention system contacts the cyclist below the occipital protuberance when the helmet body is located at the desired position on the cyclist's head.

2. The helmet of claim 1 wherein the rear stabilizer comprises a rear support member defined by the base and two laterally extending arms, the base being mounted through the rear portion of the helmet body and the helmet retention system being engaged with the laterally extending arms.

3. The helmet of claim 2 wherein the rear stabilizer is deflectable and the arms of the rear stabilizer are at least as deflectable as the base.

4. The helmet of claim 1 wherein the rear stabilizer comprises a generally Y-shaped rear support member defined by the base and two angled arms, the base being mounted through the rear portion of the helmet body and the helmet retention system being engaged with the angled arms.

5. The helmet of claim 1 wherein the rear stabilizer is deflectable and the distance between the front portion of the helmet body and the rear stabilizer is less than required for admission of a cyclist's head with the stabilizer being deflected when the cyclist's head is admitted.

6. The helmet of claim 1 wherein the rear stabilizer is deflected by tightening the helmet retention system to the cyclist's head.

7. The helmet of claim 1 wherein the rear stabilizer is more flexible in a direction toward the front portion of the helmet body than in a direction away from the front portion of the helmet body.

8. A helmet for a cyclist comprising:

a helmet body having a front portion and a rear portion;

a rear stabilizer having one portion mounted in the rear portion along the centerline of the helmet body, said rear stabilizer having a resilient base shaped to conform to the back of the cyclist's head or neck;

a helmet retention system for retaining the helmet body and the rear stabilizer in a desired position on the cyclist's head, said helmet retention system being engaged with the helmet body on oppositely disposed sides of the helmet body and being engaged with the rear stabilizer;

said rear stabilizer extending from the rear portion of the helmet body such that at least a portion of the helmet retention system contacts the cyclist below the occipital protuberance when the helmet body is located at the desired position on the cyclist's head wherein the helmet retention system comprises retention strap sections engaged with the oppositely disposed sides of the helmet body for being positioned on each side of the cyclist's head and extending downward to a point below the cyclist's ear and from that point rearward to the rear stabilizer to largely eliminate a tendency of the helmet to tilt forward.

9. A helmet for a cyclist comprising:

a helmet body having a front portion and a rear portion;

a rear stabilizer having one portion mounted in the rear portion along the centerline of the helmet body, said rear stabilizer having a resilient base shaped to conform to the back of the cyclist's head or neck;

a helmet retention system for retaining the helmet body and the rear stabilizer in a desired position on the cyclist's head, said helmet retention system being engaged with the helmet body on oppositely disposed sides of the helmet body and being engaged with the rear stabilizer;

said rear stabilizer extending from the rear portion of the helmet body such that at least a portion of the helmet retention system contacts the cyclist below the occipital protuberance when the helmet body is located at the desired position on the cyclist's head wherein the helmet retention system comprises a pair of strap units, these units being essentially mirror images of one another, being positioned on the oppositely disposed sides of the cyclist's head and each including a first strap section extending downward and rearward from the front portion of the helmet body to a junction point below the cyclist's ear, a second strap extending forward from a second end of the rear stabilizer to the junction point and a third strap section extending from the junction point to means for adjustably connecting the two third strap sections under the cyclist's chin to secure the helmet.

10. A helmet for a cyclist comprising:

a helmet body having a front portion and a rear portion;

a rear stabilizer having one portion mounted in the rear portion along the centerline of the helmet body, said rear stabilizer having a resilient base shaped to conform to the back of the cyclist's head or neck;

a helmet retention system for retaining the helmet body and the rear stabilizer in a desired position on the cyclist's head, said helmet retention system being engaged with the helmet body on oppositely disposed sides of the helmet body and being engaged with the rear stabilizer;

said rear stabilizer extending from the rear portion of the helmet body such that at least a portion of the helmet retention system contacts the cyclist below the occipital protuberance when the helmet body is located at the desired position on the cyclist's head wherein the rear stabilizer is semi-flexible and the helmet retention system comprises retention strap sections engaged with the helmet on each of the oppositely disposed sides of the cyclist's head extending downward from the front portion of the helmet body to a point below the cyclist's ear and from that point rearward to the rear stabilizer and a chin strap section extending under the cyclist's chin between the retention strap sections on each of the oppositely disposed sides of the cyclist's head such that when the cyclist snugs the helmet chin strap section the rear stabilizer is pulled forward to fit snugly against the back of the cyclist's head or neck.

11. A helmet for a cyclist comprising:

a helmet body having a front portion and a rear portion;

a rear stabilizer having one portion mounted in the rear portion along the centerline of the helmet body, said rear stabilizer having a resilient base shaped to conform to the back of the cyclist's head or neck;

a helmet retention system for retaining the helmet body and the rear stabilizer in a desired position on the cyclist's head, said helmet retention system being engaged with the helmet body on oppositely disposed sides of the helmet body and being engaged with the rear stabilizer;

said rear stabilizer extending from the rear portion of the helmet body such that at least a portion of the helmet retention system contacts the cyclist below the occipital protuberance when the helmet body is located at the desired position on the cyclist's head wherein the helmet retention system comprises:

front retention strap sections engaged with the oppositely disposed sides of the helmet body for being positioned on each side of the cyclist's head;

a clip attached to each front retention strap section;

rear retention strap sections engaged with the rear stabilizer and the clips; and a connector strap section extending between the clips.

12. The helmet of claim 11 wherein the front retention strap sections, the rear retention strap sections and the connector strap section are formed from one continuously joined strap.

13. A helmet for being worn on an individual's head to protect the individual's head comprising:

a helmet body having a front portion and a rear portion;

a resilient and deflectable rear stabilizer having one portion mounted in the rear portion along the centerline of the helmet body and an opposite free end being oriented toward the back of the individual's head and neck, said rear stabilizer being curved to accommodate the back of the individual's head and neck; and an adjustable helmet retention system for securing the helmet to the individual's head, said helmet retention system comprising retention strap sections engaged with the front portion of the helmet body on each side of the individual's head and extending downward to a point below the individual's ear and from that point rearward to the opposite free end of the rear stabilizer;

the rear stabilizer deflecting toward the front portion of the helmet body as the individual adjusts the helmet retention system.

14. The helmet of claim 13 wherein the rear stabilizer comprises a rear support member defined by a base and two laterally extending arms distal therefrom, the base being attached through the rear portion of the helmet body and the helmet retention system being engaged with the laterally extending arms.

15. The helmet of claim 13 wherein the rear stabilizer comprises a generally Y-shaped rear support member defined by a base and two angled arms, the base being attached through the rear portion of the helmet body and the helmet retention system being engaged with the angled arms.

16. The helmet of claim 15 wherein the helmet retention system is formed from one continuously joined strap.

17. The helmet of claim 16 wherein the continuously joined strap passes through the two angled arms.

18. The helmet of claim 14 wherein the rear stabilizer is more resilient and deflectable toward the back of the individual's head and neck than away from the back of the individual's head and neck.

19. The helmet of claim 18 wherein a plurality of slots oriented transversely in the rear stabilizer impart resilience and deflectability to said stabilizer.

20. The helmet of claim 19 wherein said rear stabilizer comprises:

strap retaining openings in the laterally extending arms.

21. A support member for improving a retention system of a cyclist's helmet comprising:

a retaining clip; and a resilient, inverted Y-shaped mounting arm having means attached at a proximal end for extending through the helmet and engaging the retaining clip at a rear portion of the cyclist's helmet and at least two angled arms extending generally laterally from a distal end of the mounting arm for receiving the helmet retention system through openings in said angled arms, said mounting arm being semi-flexible and curved to accommodate the back of the cyclist's head and neck, said mounting arm being attached to the rear portion of the cyclist's helmet by engaging said retaining clip.

22. The support member of claim 21 wherein said semi-flexible mounting arm further comprises a plurality of slots orientated transversely in the mounting arm to allow the mounting arm to flex toward the back of the cyclist's head and neck.

* * * * *